US005081793A

United States Patent [19]

Mauro

[11] Patent Number: 5,081,793

[45] Date of Patent: * Jan. 21, 1992

[54] WOOD CLAD WINDOW ASSEMBLY AND ASSOCIATED METHOD

[76] Inventor: Gerald D. Mauro, 135 Springhouse La., Pittsburgh, Pa. 15238

[ * ] Notice: The portion of the term of this patent subsequent to Jun. 13, 2006 has been disclaimed.

[21] Appl. No.: 534,971

[22] Filed: Jun. 7, 1990

[51] Int. Cl.[5] ..... E06B 3/00

[52] U.S. Cl. ..... 49/501; 49/504; 52/507

[58] Field of Search ..... 49/401, 400, 402, 504, 49/501, 460, 503, 505; 52/211, 212, 63, 455, 456, 656, 631, 506, 507, DIG. 8; 160/90

[56] References Cited

U.S. PATENT DOCUMENTS

| | | | |
|---|---|---|---|
| 2,639,472 | 5/1953 | Jönsson . | |
| 3,042,160 | 7/1959 | Price . | |
| 3,130,455 | 4/1964 | Borlenghi . | |
| 3,221,462 | 12/1964 | Pomeroy . | |
| 3,364,623 | 1/1968 | Sklar . | |
| 3,815,285 | 6/1964 | Kuyper . | |
| 3,890,754 | 6/1975 | Spurdle . | |
| 4,097,100 | 6/1978 | Sauder . | |
| 4,122,633 | 10/1978 | Holdiman | 49/504 X |
| 4,207,707 | 6/1980 | Holdiman et al. | 49/504 X |
| 4,265,052 | 5/1981 | Johnson et al. . | |
| 4,328,644 | 5/1982 | Scott et al. . | |
| 4,341,048 | 6/1982 | Minter . | |
| 4,391,072 | 6/1983 | Moore . | |
| 4,479,331 | 10/1984 | Bertolami et al. . | |
| 4,558,536 | 12/1985 | Dunsmoor . | |
| 4,587,759 | 5/1986 | Gray . | |
| 4,590,723 | 5/1986 | Nassau et al. . | |
| 4,837,799 | 6/1989 | Mauro . | |

*Primary Examiner*—Philip C. Kannan
*Attorney, Agent, or Firm*—Arnold B. Silverman

[57] ABSTRACT

A clad window assembly for a window having a sash insertable into the window from the exterior such as a casement window, an awning window or a picture window has nonwooden frames and sashes secured to each other. A plurality of first wood cladding members are secured to the frame inner surface and a plurality of second wood cladding members are secured to the sash. This establishes the appearance of a wooden window on the inner surface of the window. If desired, at least two of the first cladding members may have an elongated recess which may be employed to receive a screen. An elongated lip may project generally outwardly from the other side of wood cladding members. The second wood cladding members may be an elongated block used for securement of the window pane. The nonwooden frame and first wood cladding members may have different configurations on different portions of the window. Wood cladding mullion and muntin members may be employed. An associated method is provided.

49 Claims, 7 Drawing Sheets

WOOD CLAD WINDOW ASSEMBLY AND ASSOCIATED METHOD

BACKGROUND OF THE INVENTION

1. Field Of The Invention

The present invention is directed toward a clad window assembly wherein the window frame and sash are nonwooden and wooden cladding is applied thereto and to an associated method of making such a window.

2. Description Of The Prior Art

Various forms of windows having a frame element secured to an opening in a building and a cooperating sash member which has one or more panes of glass have been known. The sashes may be movable with respect to the pane as by sliding movement in single-hung or double-hung windows, for example, or rotational movement outward or inward. With respect to outwardly rotatable windows, casement windows rotate outwardly about a generally vertical axis and awning windows rotate outwardly about a generally horizontal axis. In general, there has been an attempt to provide the desired structural and functional performance for a particular installation. For example, the transparent or translucent plastic or glass pane may have single or multiple panes of a fixed or movable sash variety, while preserving the desired appearance and durability.

It has been known to provide windows made of frames and sashes composed of metal, such as aluminum, vinyl, fiberglass and wood, with single panes or multiple panes with an interposed dead air space to provide enhanced thermal insulation.

It has also been known to attempt to combine materials so as to get a blend of desirable properties. It has been known, for example, to provide a window which is structurally a wooden window with an exterior protective cladding of metal or plastic. See U.S. Pat. Nos. 3,815,285, and 4,341,048, 4,479,331. The objective in these instances was to protect the wood against exposure to weather and thereby reduce the amount of required window maintenance. See also U.S. Pat. Nos. 4,391,072 and 4,590,723.

U.S. Pat. No. 4,328,644 discloses a plastic clad window in which the frame subassembly and sash subassembly included a plastic shell designed to cover the wooden frame to resist exposure to the elements. U.S. Pat. No. 4,558,536 discloses a composite double-hung window wherein an exceptionally complex and costly combination of metal and wood is employed in an effort to provide wood cladding on the interior surface of a metal window. In this instance, the window is not a complete functional window without both the metal and wood portions.

It has also been known to provide various forms of trim members for doors and windows including wood trim. See generally U.S. Pat. Nos. 3,042,160 and 3,364,623.

U.S. Pat. No. 4,587,759 discloses a security window wherein reinforcing rods are disposed in positions corresponding to the positions of the muntins on the particular window. U.S. Pat. No. 3,221,462 discloses a removable mullion unit which is removably secured to the sash by mechanical fasteners.

My U.S. Pat. No. 4,837,977 discloses an advantageous blend of a nonwood frame and nonwood sash which has wood cladding secured to the frame and sash in a manner to present an aesthetically appealing uniform interior wood appearance while preserving the functional aspects of the nonwood portion of the window. In addition, this patent discloses a form of cladding which may be applied to mullions.

Despite the foregoing teachings there remains a need for further improvements in systems which seek to provide the highly desirable interior appearance of wood in casement, awning and fixed pane windows such as picture windows while maintaining the dimensional characteristics of the original window.

SUMMARY OF THE INVENTION

The clad window assembly of the present invention has a sash which is mounted to the window frame from the exterior of the frame. In such constructions, cladding the interior of the nonwood sash and frame may be effected in accordance with the present invention in such a manner as to effect the desired interior wood appearance without interfering with the structural and functional characteristics of the window. A nonwooden frame has an inner surface, outer surface, a sash engaging surface and a wall engaging surface. The associated nonwooden sash has an exterior surface, an interior surface, a pane engaging surface and a frame engaging surface. A pane is sealingly secured within the sash.

A plurality of first wood cladding members are secured to the frame inner surface and a plurality of second wood cladding members are secured to the sash. The wood cladding provides a wooden appearance on the interior surface of the window. If desired, at least two opposed wood cladding members may have an elongated recess on the side thereof closer to the sash in order to provide for screen retention.

Where the window has a movable sash, hardware openings will be provided in the first wood cladding members. This facilitates the use of standard hardware. If desired, custom hardware could be employed to permit surface mounting of the hardware.

Some of the frame or first wood cladding members may have an elongated lip which projects outwardly from the side of the first wood cladding member adjacent to the frame outer surface.

In one of the embodiments of the invention, the nonwooden frame will be made with a plurality of frame elements some of which will have a different shape from others. The associated first wood cladding members will have a complimentary shape and, therefore, will not all necessarily be of the same shape as other nonwood cladding members.

The window may have mullion means and a third wood cladding means may be secured in overlying relationship with respect thereto. The mullions permit two or more sashes to be employed within a single main frame.

The method of the present invention includes providing a window having a nonwooden frame and a nonwooden sash. First wood cladding members are secured to the nonwooden frame and second wood cladding members are secured to the nonwooden sash. This is accomplished in a manner so as to substantially cover the nonwooden frame portions with the exception of any hardware openings which may be on the window. Some first wood cladding members, which are secured to the frame, may be of the same shape as the other first wood cladding members or some or all of the first wood cladding members for a given frame may be of different shapes rather than all identical. The same variations may be employed for the second wood cladding members which are secured to the sash.

It is an object of the present invention to provide a clad window assembly wherein a nonwooden frame and a nonwooden sash have secured thereto wood cladding members so as to provide the internal appearance of a wooden window.

It is a further object of the present invention to provide such a window wherein mullions may also be clad in this manner.

It is yet another object of the invention to provide such a system wherein cladding may be retrofit into existing windows or may be employed on standard sized or custom-made windows.

It is a further object of the invention to provide such a window assembly which permits flexibility of design and the opportunity to custom design and optimize the functional and aesthetic features.

It is yet another object of the invention to provide such a window assembly which may be employed without requiring alterations of the building opening or window dimensions.

It is a further object of the invention to provide such a system which may be employed with standard hardware.

It is another object of this invention to provide a unitary sash cladding-muntin assembly.

It is a further object of the invention to provide a method of making a window assembly of the present invention.

These and other objects of the invention will be more fully understood upon reference to the illustrations appended hereto.

DESCRIPTION OF THE PREFERRED EMBODIMENTS

As used herein the word "window" means windows which open by projecting outwardly and fixed nonoperable windows, such as picture windows, which have the window sash mounted on the window frame from the exterior of the window frame and shall expressly include, but not be limited to, such constructions secured within exterior walls of buildings and roofs thereof, such as skylights, and shall include multiple sash windows having a mullion to separate adjacent sashes and windows of rectangular and other shapes, but shall not include single-hung windows, double-hung windows and doors.

The present invention relates to certain improvements over the invention disclosed in my prior U.S. Pat. No. 4,837,977 the disclosure of which is expressly incorporated herein by reference.

Figure 1:
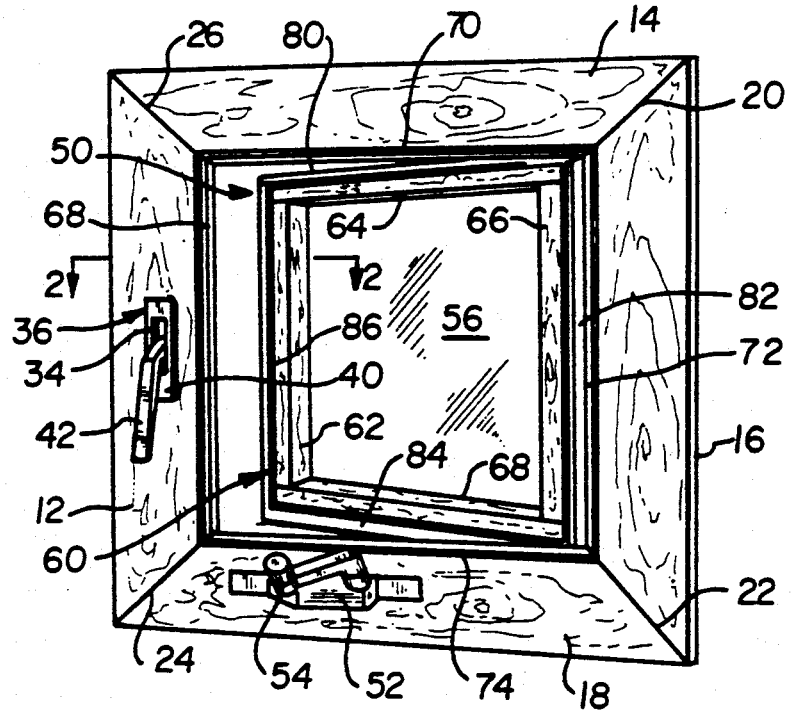
FIG. 1 is a perspective view of the interior of a clad window assembly of the present invention.
Figure 2:
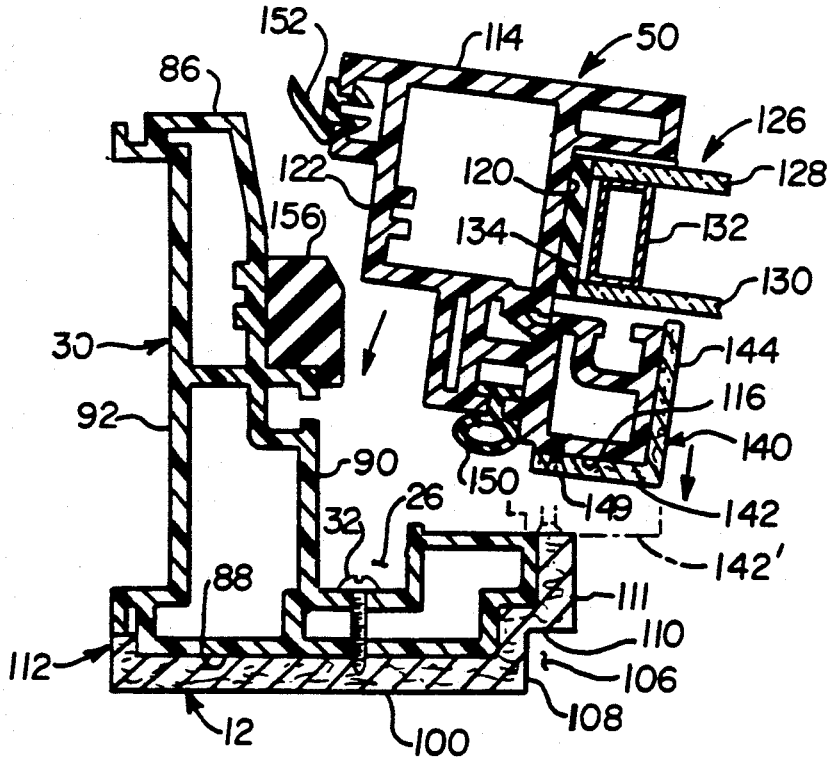
FIG. 2 is a cross-sectional view of the wood clad window frame and wood clad window sash taken through 2—2 of FIG. 1.

Referring more specifically to FIGS. 1 and 2 there is shown a nonwooden window after securing thereto four first wooden cladding members 12, 14, 16, 18 which are joined to each other by mitered connections 20, 22, 24, 26. These first wood cladding members 12, 14, 16, 18 are secured to the inner surfaces of the nonwooden window frame, such as is shown in FIG. 2. First wood cladding member 12 is secured to nonwooden frame member 30 by means of screw 32 which enters the wood cladding 12 from the portion in surface-to-surface contact with the nonwooden frame element 30 and does not penetrate fully through the wood cladding 12. This serves to preserve the desired aesthetic appearance of the wood and to structurally enhance the overall composite frame. The first wood cladding member 12 has an opening 34 therein. Locking assembly 36 includes a plate member 40 and a rotating lever 42 which engages with a lock opening (not shown) so as to secure the window in locked position. The locking assembly 36 is operatively associated with the opening 34. If desired, the hardware receiving opening 34 may be eliminated or reduced in size and special hardware could be mounted on the wood surface.

Similarly, opening 52 in first wood cladding member 18 permits operating handle 54, which serves to open and close the window, to pass therethrough. Surface mounting of special hardware could also be employed in this embodiment. It will be appreciated that apart from the hardware openings, the first wood cladding substantially continuously covers the nonwooden frame members to provide a uniform, aesthetically appealing wooden interior window surface.

The window shown in FIGS. 1 and 2 is a window which has a nonwooden frame secured to a nonwooden sash which rotates about a vertical axis and projects outwardly when opened. The window may be made of aluminum, vinyl, steel or fiberglass, for example.

The sash member 50 has a pane 56 which may be a transparent or translucent glass or plastic panel, for example. The pane 56 may consist of a single pane or multiple panes which may be sealingly joined to each other so as to provide a dead air space for thermal insulation.

The sash 50 has a nonwooden sash frame 60 to which has been secured a plurality of second wood cladding members 62, 64, 66, 68. The sash frame 60 when in closed position, is engaged with the nonwooden window frame 30.

While in the form illustrated the nonwooden window is shown as being of rectangular configuration, it will be appreciated that the present invention may be employed with a wide variety shapes such as squares, circles, trapezoids, ellipses, or other desired shapes.

In the form illustrated in FIG. 1, the nonwooden frame has four frame elements 68, 70, 72, 74, and the sash 50 has four sash elements 80, 82, 84, 86.

Referring, now, in greater detail to FIG. 2. A portion of the nonwooden frame and nonwooden sash will be considered in greater detail along with the associated wood cladding members. The frame element 30 has an outer surface 86 an inner surface 88, a sash engaging surface 90 and a wall engaging surface 92. Secured in intimate surface-to-surface contact with nonwooden frame inner surface 88 is first wood cladding member 12 which has a body portion 100 which is in surface-to-surface contact with frame inner surface 88. One end of first wood cladding member 12 has a recess 106 defined by a zigzag portion 108, 110, 111 of the wood cladding member. At the other end, in the form shown is an outwardly projecting lip 112 which is oriented generally perpendicularly with respect to the body portion 100 and is in engagement with the frame wall engaging surface 92.

Still referring to FIG. 2, the nonwooden sash element has an exterior surface 114, an interior surface 116, a pane engaging surface 120, and a frame engaging surface 122. The pane 126 in the form shown consists of two window panes 128, 130 separated by a divider 132 and has an end or setting block 134. Second wood cladding member 140 which in the form shown is generally L-shaped has one leg 142 secured in surface-to-surface engagement with a portion of the interior surface 116 of the sash 50 and a further portion 144 in engagement with a portion of the pane engaging surface 120 of the sash 50. Screw 149 secures second wood cladding member 140 to sash frame 150. In lieu of screw 149, other means of securing cladding member 140 to sash 50, such as the use of a wooden dowel or an adhesive, for example, may be employed. It will be appreciated that when the sash 50 is in closed position with respect to the frame 30, the inner surface 142 of second wood cladding member will be in the position shown in phantom 142 and that the visible portion of the frame and sash as viewed from the interior will provide the wooden appearance of portions 100, 142 thereby achieving the desired interior wooden appearance.

In the form shown in FIG. 2, both the frame 30 and the sash 50 which are nonwooden are made of a vinyl material which has been extruded to provide the desired shapes. Suitable sealing means which facilitate intimate sealed relationship between the sash 50 and frame 30 when the sash is in the closed position such as hollow gasket 150, gasket 152 and sash centering block 156 are provided.

Referring still to FIG. 2, a screw 32 passes through two portions of the nonwooden frame and enters cladding member 12 to secure the same in intimate relationship with frame 30. This is done in a manner which preferably presents no visible fastener as viewed from the interior as the screw 32 does not pass fully through first wood cladding member 12. It will be appreciated that other means of securing the wood cladding to the frame or sash may be employed. For example, the wood cladding members could be provided extending with glue on the surfaces which will contact the nonwooden frame or sash elements and be glued into position. As a further alternative, a screw could be provided outwardly through the interior surfaces of the wood cladding members with the screw being countersunk and appropriate filler material being provided. If desired riveting could also be employed for this purpose. As a further alternative, the nonwooden frame or sash could have raised portions which mechanically interengage corresponding recesses in the wood cladding members.

As shown in FIG. 2, a channel area 26 which is adapted to receive the locking and pivoting system 42 and the crank system 52, 54 is provided.

Figure 3:
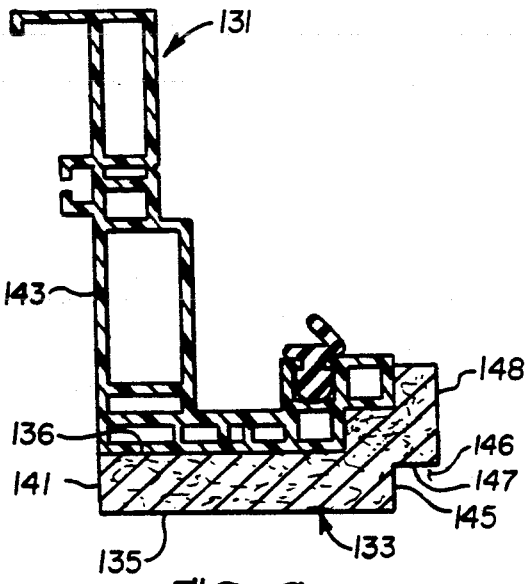
FIG. 3 is a cross-sectional illustration of another embodiment of the invention showing a wood clad window frame portion.

Referring to FIG. 3, there is shown a modified form of nonwooden frame 131 which has a first wood cladding member 133 secured thereto. The first wood cladding member 133 has a body portion 135 which has a surface 136 in intimate surface-to-surface engagement with the frame member. As is true of the embodiment of FIGS. 1 and 2, the wood cladding elements are contoured so as to be in intimate surface-to-surface contact with the associated frame. Unlike the embodiment of FIG. 1, no projecting lip element 112 (FIG. 1) is contained in this embodiment and the end surfaces 141 of the first wood cladding member 133 and a surface 143 of the framing member 131, in the form shown, are generally coplanar. At the other end of first wood cladding member, a recess 146 is defined by zigzag portion 145, 147, 148.

It will be appreciated that the wood cladding members such as 132 may have any desired thickness which does not interfere with functioning of the window. For example, the first wood cladding may have a minimum thickness of about 1/32 inch to a maximum thickness of about 2 to 3 inches. The same thicknesses may be employed with the second wood cladding members so long as the maximum thickness is not so great as to interfere with the mechanical functioning of the window assembly.

It will be appreciated by a comparison of FIGS. 2 and 3 that among the variations contemplated in the present invention are the use of the first wood cladding members secured to the frame inner surface which either do or do not have a lip and do, or do not, have a recess such as 106 or 146 defined respectively by zigzag portions 108, 110, 111 and 145, 147, 148. If desired, recess 146 could be eliminated with the inner body portion surface 135 meeting surface 148 such as the right angle intersection of surfaces 135 and 148, if a screen recess is not desired. Regardless of the presence or absence of lips or screen receiving recesses, it is generally preferred that the inner surface of the body portion of the wood cladding members be in intimate surface-to-surface engagement with the adjacent nonwooden frame member.

While the nonwooden frame 10 and the sash 50 may have frame elements and sash elements which are of substantially identical configurations throughout the frame or sash, it is contemplated by the present invention that frame members of a first frame shape may be combined with members of another shape in creating a frame and that sash members of a first sash shape may be combined with others of a different shape in creating a sash member. Similarly, the profile of the first wood cladding members may differ from section to section on the same window or may be identical and the profile of the second wood cladding members may differ from section to section within a given sash or may be identical. Similarly, the framing elements, sash elements, and wood cladding members may be joined to adjacent members by a miter joint, a butt joint or other desired type of joint.

Figure 4:
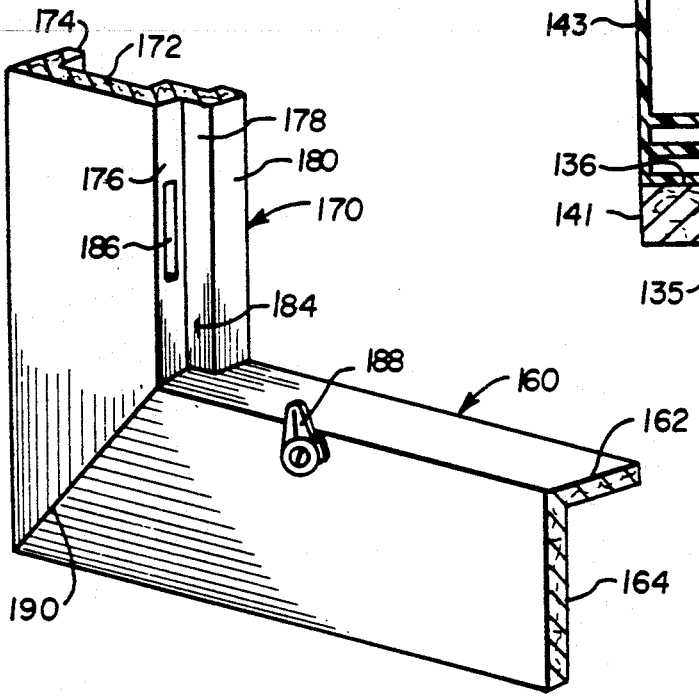
FIG. 4 is a schematic illustration showing a modified form of wood cladding for the window frame.

Referring to FIG. 4, in this embodiment, a pair of connected first wood cladding members 160, 170 are of different profile. The horizontally oriented cladding member 160 is generally L-shaped and has a horizontal portion 162 and a generally perpendicularly oriented downwardly depending portion 164. By contrast, the vertical member 170 has a body portion 172, a projecting lip 174, and at the other end, a generally zigzag shaped segment created by sectors 176, 178, 180 so as to define a screen receiving recess 184. This system is adapted to have differing forms of inter-engagement with the respective sectors of the nonwooden frame to which they will be secured. Also, opposed to element 170 will be a similarly configured frame member which also has a recess such as recess 184. The horizontal upper rail may be similar to lower rail 160. In this manner, a screen may be received within the recesses in the vertical rails and secured in place by any desired means such as a number of slits such as slit 186 in wall 176 and its corresponding wall on the other vertical member with rotatable knife means (not shown) on the screen frame adapted to be introduced into the slits to secure the screen in place. As an alternative, or in addition, rotatable surface mounted retention clips such as clip 188 may be employed for screen frame retention. In this embodiment cladding members 160, 170 are joined by a miter joint 190.

Figure 5:
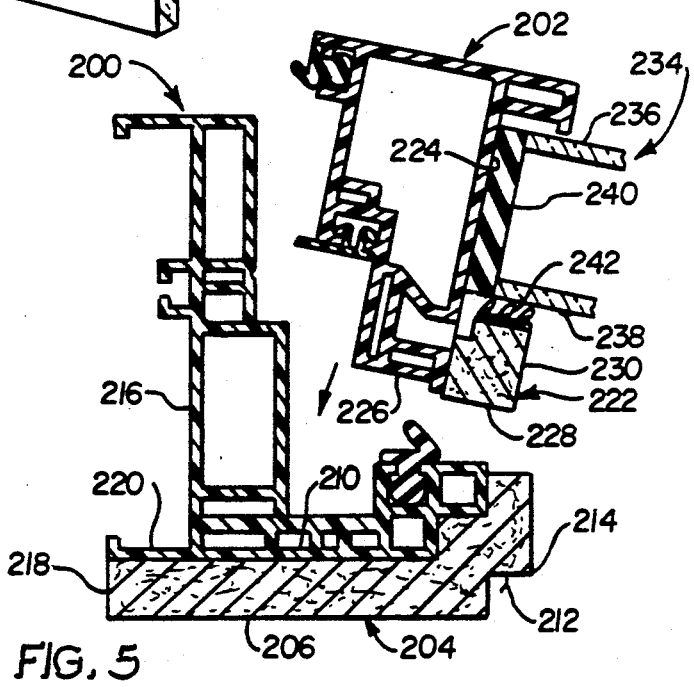
FIG. 5 is a cross-sectional illustration of another embodiment of the wood clad window frame and wood clad sash.

Referring to FIG. 5, there is shown a further modified form of cladding. In this embodiment, modified nonwooden frame elements 200 and cooperating nonwooden sash elements 202 are provided. The first wood cladding member 204 has a body portion 206 which is in intimate surface-to-surface engagement and generally of complimentary shape with respect to the inner surface of lower portion 210 of frame 200. A screen receiving recess 212 is provided by zigzag portion 214. In this embodiment, however, the frame wall engaging surface 216 is inwardly offset with respect to the end surface 218 of the first wood cladding member 204. In this embodiment, the frame has a flanged extension 220 which is generally co-extensive with end 218 of first wood cladding members 204. This offset between frame surface 216 and first wood cladding end 218 provides greater versatility in retrofit applications and also facilitates an extension or return jamb to be employed to create the desired window jamb depth.

Referring to the sash element 202 in FIG. 5, the second wood cladding member 222 in this embodiment is a wooden block which is secured to the pane engaging surface 224 of the sash member 202. The second wood cladding member 222 has a surface 228 which is in a plane generally parallel to the plane of the interior surface 226 of the sash element 202 and a second surface 230 which is generally perpendicular with respect thereto. A pane 234 in the form shown has a pair of spaced glazing materials 236, 238 and an end rubber spacer block 240. A dead air space is disposed between panes 236, 238 to enhance the thermal insulation characteristics of the pane 234. Interposed between the inner surface of window 238 and adjacent the second wood cladding means 222 is a weather-stripping element 242 which resists infiltration of air and foreign matter through the interior of the window. It will be appreciated, therefore, that in this embodiment the second wood cladding members 222 in addition to providing the desired interior wood appearance, functions as a glass or pane securing block. In this embodiment, as in other embodiments, the first and second wood cladding members are generally co-extensive with the surfaces of the nonwooden frame and nonwooden sash to which they are secured such that apart from any hardware openings, there will preferably be no meaningful exposure of the nonwooden frame or sash on the interior of the window when the sash is in a closed position.

Figure 6:
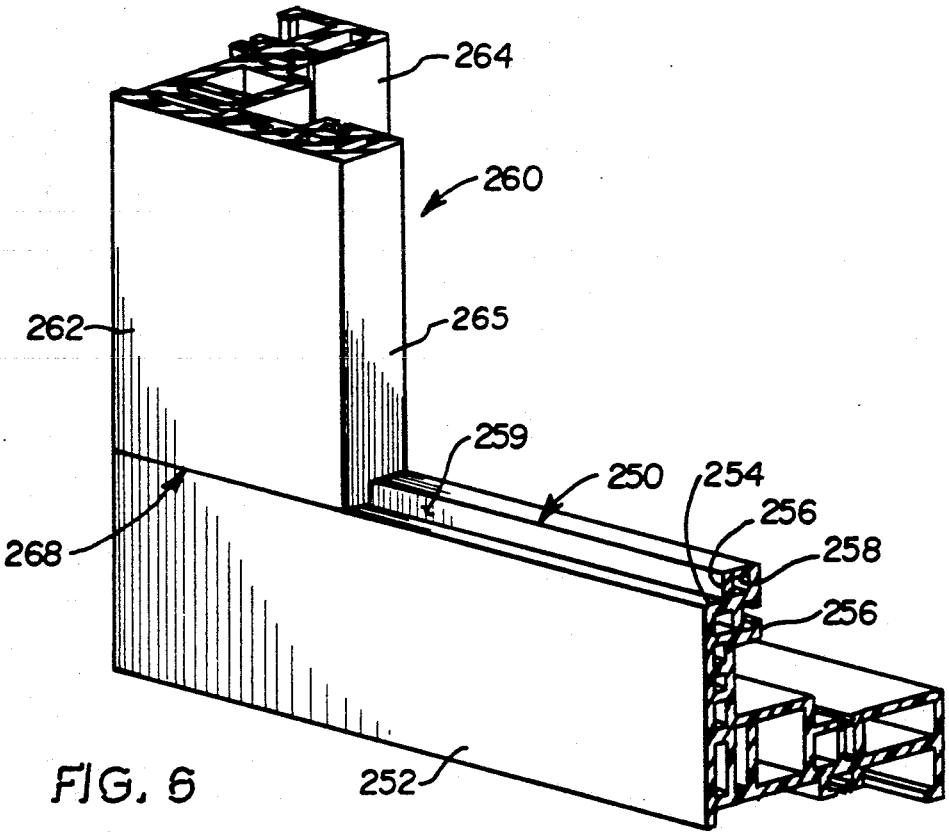
FIG. 6 is a schematic illustration of two sections of a nonwooden window frame.

Referring to FIG. 6, there is shown a nonwooden frame which has dissimilar horizontal and vertical frame elements. The horizontal frame 250 has an inner frame wall 252 which terminates in a generally zigzag shaped portion 254, 256, 258 defining an elongated recess 259. No lip is present at the other end of wall member 252. This horizontal frame 256 is joined to a nonwooden vertical frame member 260 which has an inner wall 262, a sash engaging wall 264, and a connecting wall 265. Vertical member 260 is joined to horizontal member 250 in a butt joint 268. The other vertical and horizontal frame elements may have the identical cross-sectional configuration to these illustrated vertical and horizontal members in FIG. 6 and cooperate to define a generally rectangular nonwooden frame.

Figure 7:
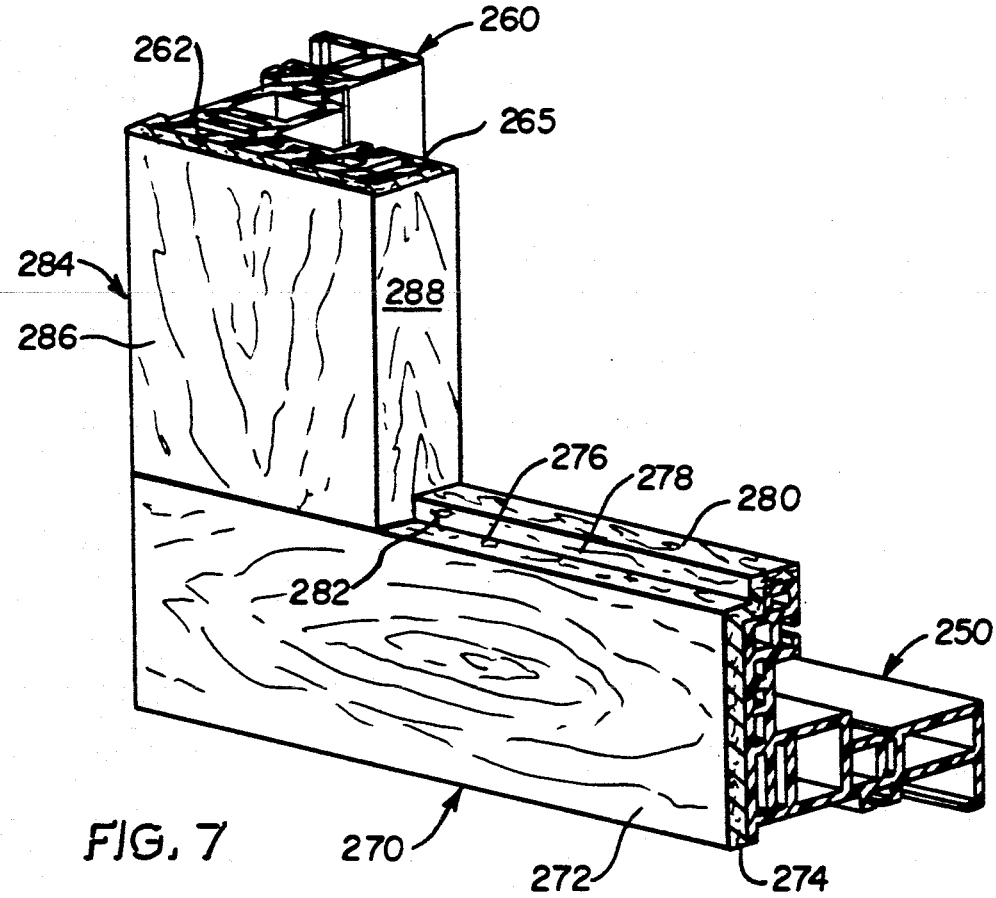
FIG. 7 is a schematic illustration of the nonwooden frame sections of FIG. 6 to which wood cladding has been secured.

Referring to FIG. 7, the frame of FIG. 6 is shown covered by wood cladding members. More specifically, the horizontal framing member 250 has secured generally co-extensively thereto and in general surface-to-surface engagement first wood cladding member 270 which has an elongated body portion 272, a straight end 274 devoid of a lip and a generally zigzagged portion defined by sections 276, 278, 280 which cooperate to define an elongated screen receiving recess 282. The vertical first wood cladding member 284 is generally L-shaped and has a first wall 286 and a generally perpendicularly oriented second wall 288, with both being in surface-to-surface engagement respectively with wall 262 and wall 265 of vertical frame member 260. It will be appreciated that in this embodiment different frame shapes and different cladding shapes cooperate to define a nonwooden window frame having wooden cladding secured thereto.

Figure 8:
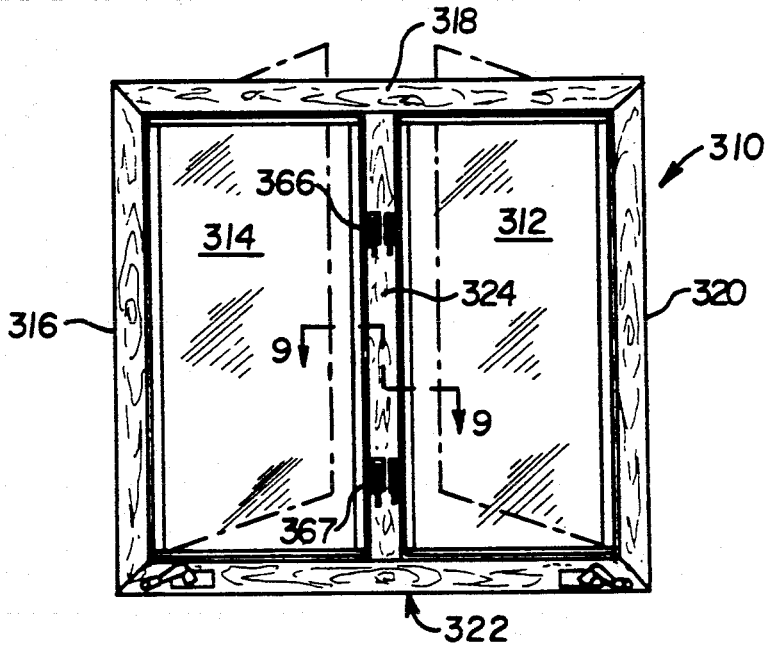
FIG. 8 is a front elevation view of a clad assembly of the present invention having two sash units separated by a mullion with the sashes in closed position.
Figure 9:
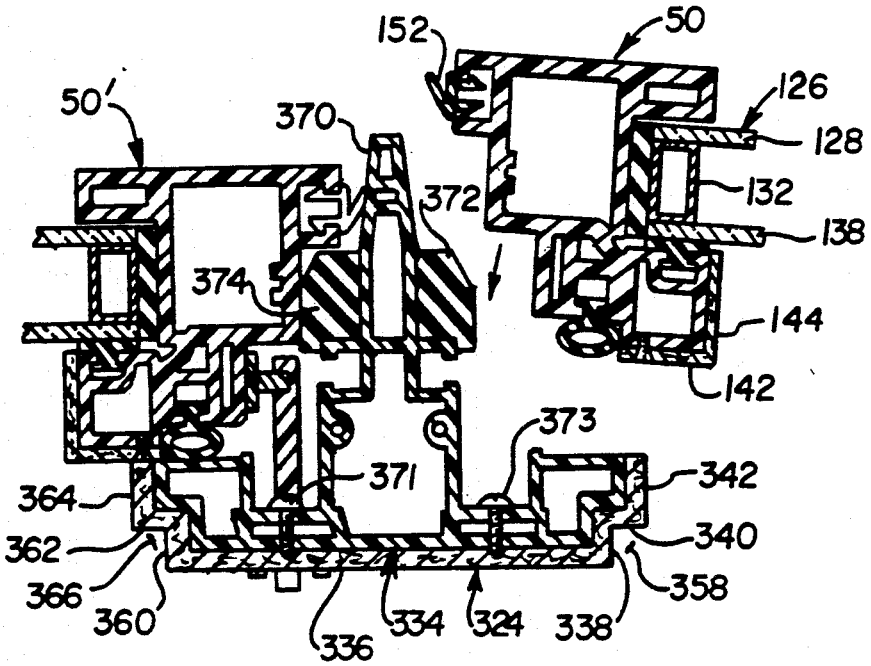
FIG. 9 is a cross-sectional illustration of a portion of the window of FIG. 8 taken through 9—9 showing the mullion.

Referring to FIGS. 8 and 9, there is shown a window 310 having two sashes 312, 314 which are surrounded by a wood clad nonwooden frame which has sections 316, 318, 320, 322, and 324. The wood cladding on the window frame except for section 324 may be generally similar to that previously disclosed herein and the sash wood cladding may be generally similar to that previously disclosed herein. Third wood cladding 324 covers a mullion 334. This wood cladding has a body portion 336 and a pair of zigzag ends 338, 340, 342 which defines recess 358 and 360, 362, 364 which defines recess 366. In the form shown, the third wood cladding member 324, which is the mullion cladding is preferably of substantially uniform cross-section throughout its length except for the regions of hardware 366, 367

(FIG. 8) and is preferably in intimate surface-to-surface engagement with the underlying mullion 334. In the embodiment shown, the mullion 334 is secured to the cladding 324 by a pair of screws 371, 373 which pass through the mullion 334 and enter but do not pass completely through the wood cladding 324. It will be appreciated that in this manner a pair of screen receiving recesses 358, 366 are provided in third wood cladding member 324. The rear portion 370 of the mullion framing member 334 has a pair of sash centering blocks 372, 374 against which the sashes 50, 50' will seal.

Figure 10:
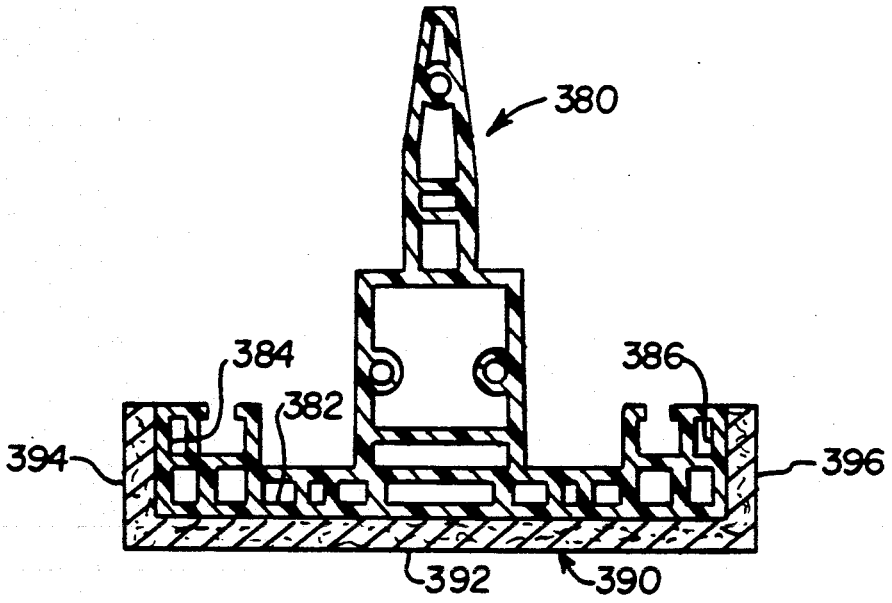
FIG. 10 is a partial cross-sectional illustration of a modified form of clad mullion of the present invention.

Referring to FIG. 10, a modified form of mullion cladding is illustrated. In this embodiment the window frame mullion 380 has a forward wall 382 which has a pair of outwardly directed flanges 384, 386. In this embodiment, the third wood cladding mullion cladding 390 has a body portion 392 and a pair of lateral flanges 394, 396 which are in intimate surface-to-surface contact with mullion frame portions 382, 384, 386 and are secured thereto by any suitable means such as adhesive means. It will be appreciated that the mullion cladding 390, in this form, has a generally channel shape and is devoid of screen frame receiving recesses.

In the form shown in FIGS. 1 and 8, relatively large openings are provided in the wood cladding in order to receive the latching and operational hardware. As used herein such construction is not deemed to depart from the cladding having a substantially uniform cross-sectional shape throughout its length. An optional approach to providing for hardware, is shown in FIG. 11 wherein a piece of wood cladding 400 has a body portion 402, a projecting lip adjacent one end 404, a zigzag portion defined by walls 406, 408 and 410 to define screen receiving recess 412.

Figure 11:
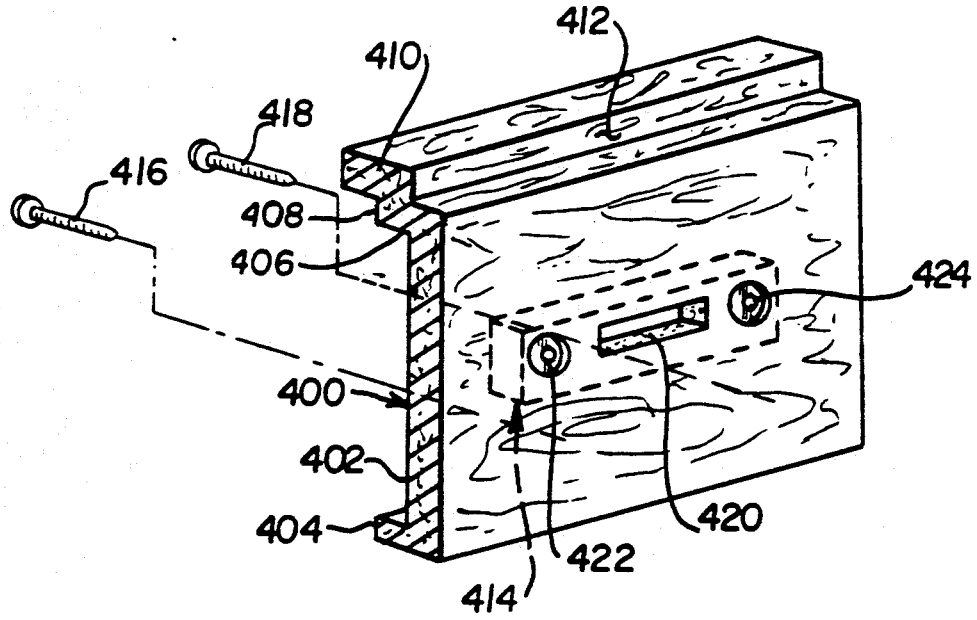
FIG. 11 is a modified form of hardware opening in the wooden cladding.

In the embodiment of FIG. 11, rather than creating the size opening shown by the dotted representation 414, smaller openings are employed. A pair of screws 416, 418 secure the wood cladding to the nonwood framing member (not shown). A slot 420 for receiving the roto-gear and holes 422, 424 for mounting the hardware are provided.

Figure 12:
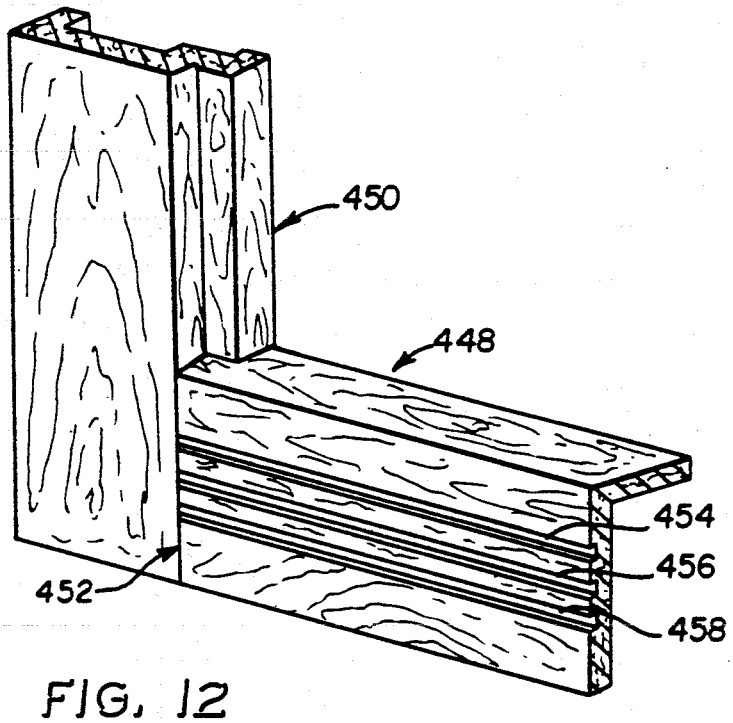
FIG. 12 is a partially schematic perspective view of a modified form of wood cladding of the present invention.

It will be appreciated that various types of decorative features may be provided on or in the wood cladding. These may be integrally formed or separately formed and secured to the cladding. For example, as is shown in FIG. 12, a horizontally oriented first wood cladding member 448 is secured to vertically oriented first wood cladding member 450 by means of a butt joint 452. The interior surface of first wood cladding member 448 has integrally formed longitudinal grooves 454, 456, 458 which are coextensive with cladding member 448 and, in the form shown, are generally parallel to each other.

Figure 14A:
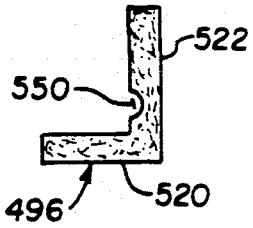
FIG. 14A is a cross-sectional illustration of the sash cladding of FIG. 14.
Figure 13:
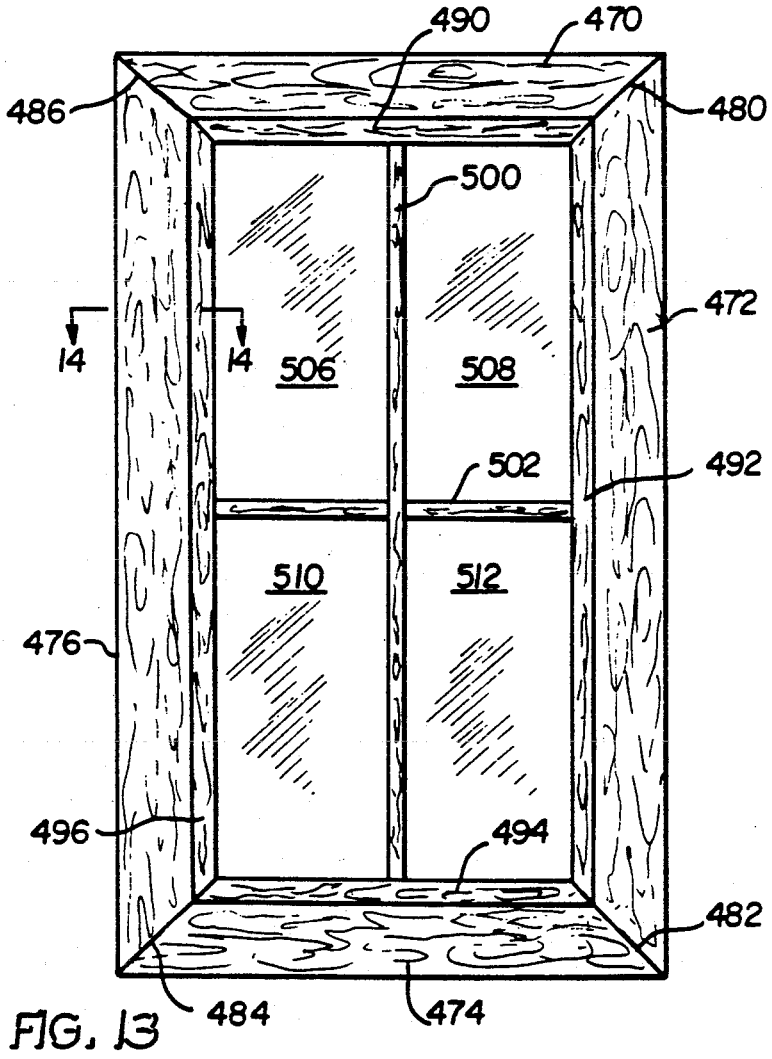
FIG. 13 is a front elevational view of another embodiment of a window having a sash muntin cladding of this invention.
Figure 14:
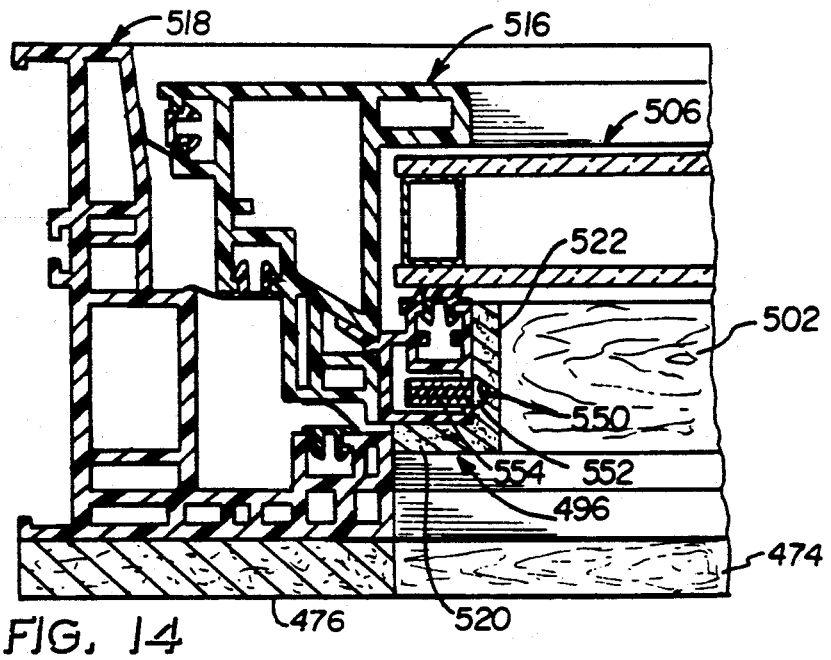
FIG. 14 is a cross-sectional view of the assembly of FIG. 13 taken through 14—14.

Shown in FIGS. 13 and 14 are a modified form of the invention which employs a sash-muntin combination. With reference to FIG. 13 there is shown a wooden clad window frame consisting of sections 470, 472, 474, 476 with adjacent sections joined at mitered connections 480, 482, 484, 486. The wood cladding which covers the sash consists of a plurality of generally L-shaped sections 490, 492, 494, 496. Muntin element 500 and muntin element 502, which is oriented generally perpendicular thereto, are secured respectively to wood cladding portions 490, 494 and 492, 496. The muntins serve to divide the window pane into four pane elements 506, 508, 510, 512. It will be appreciated that in this embodiment the sash cladding also serves as a frame to which muntin elements 500, 502 are directly secured, thereby eliminating the need to secure the muntin elements 500, 502 to a separate frame which would then be secured to a sash frame. This approach facilitates installation and removal of the sash frame and muntin as a unit and economy of manufacture.

As is shown in FIG. 14, nonwooden sash 516, which in the form shown is plastic, cooperates with nonwooden frame 518 in creating the window. Generally L-shaped wood cladding portion 496 has a first leg 520 and a second leg 522. Muntin member 502 is secured to leg 522 by any suitable means such as adhesive or mechanical fasteners, for example. It will be appreciated that in this manner, the wood cladding 490, 492, 494, 496 for the sash 516 also serves as the framing and securement means for muntins 500, 502. In this fashion, a unitary member may be employed to provide both the wooden sash cladding and the muntin cladding. Nonwooden framing member 518 is associated with first cladding member 476.

Figure 15:
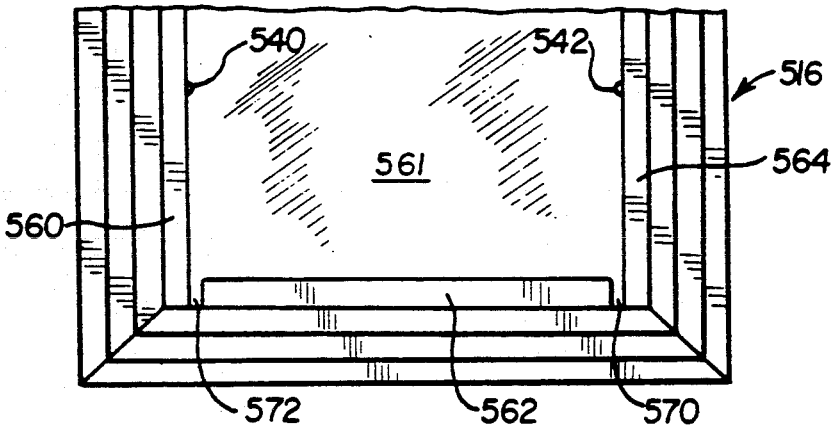
FIG. 15 is a partial elevational view of the nonwooden sash underlying the cladding of FIG. 13.

Referring to FIG. 14, 14A and 15, there is shown a part of the sash portion of the window of FIG. 13 without the cladding. Pane 561 is unitary, but in FIG. 13 is divided into pane elements 506, 508, 510, 512 by muntins 500, 502. It will be noted in FIG. 15 that a pair of spring biased locking elements 540, 542 project inwardly from the sash. A similar pair (not shown in FIG. 15) appear on the upper portion. Referring to FIG. 14, it will seen that the leg 522 of the sash cladding 496 has an elongated generally concave groove 550 which is of complementary shape and dimensions and receives securement means 552 which is biased outwardly by means of coil spring 554 (FIG. 14). The securement means 552 may be a hollow member having a convex shape facing elongated groove 550. As a result of the groove 550, which preferably is substantially coextensive in length with the vertical sash cladding members 492, 496, the need for providing separate hardware elements on the sash cladding for purposes of retention is eliminated. Also, this continuous groove approach facilitates easy installation and removal of the sash-muntin member as precise indexing of securement means 552 with cladding individual recesses is not required.

Referring again to FIG. 15, a further feature of the invention will be considered. The sash member, which is indicated in FIG. 14 as 516, is shown in FIG. 15 without the cladding. The lower glazing stop 562 which cooperates with glazing stops 560, 564, and a similar glazing stop disposed at the upper end of the window pane and of substantially identical size and shape to 562. This reduced size glazing stop 562 and its corresponding upper horizontal member (not shown) serve to facilitate ease of replacement of the glass pane. More specifically, it will be appreciated that the glazing member 562 is sufficiently short as to provide gaps 570 and 572 between the ends of glazing member 562 and the vertical glazing stops 560, 564. This facilitates ease of removal of member 562 and its corresponding upper horizontal glazing member to facilitate replacement of the glass once the wood cladding has been removed. The wood cladding units may be removed as a unit with the glazing stops to which they are secured.

Figure 16:
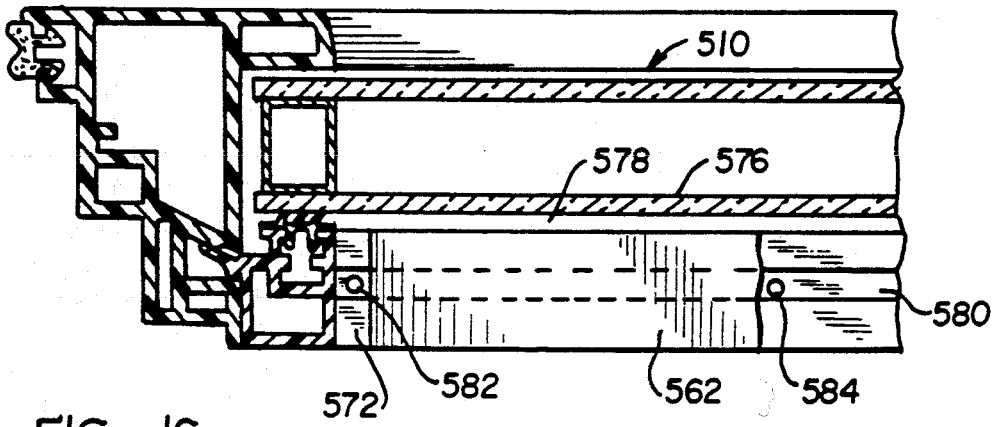
FIG. 16 is a fragmentary plan view of a portion of the sash of FIG. 13 showing a drainage system.

A further feature of the invention is shown in FIGS. 15 and 16. It will be noted that between glazing stop 562 and the innermost glass pane 576 is a gap 578. Moisture condensing on the interior surface of pane 576 will flow under the influence of gravity down into gap 578 and then into elongated upwardly open trough 580 which underlies glazing stop 562 and has a plurality of discharge openings 582, 584 by which the moisture may be discharged from the region where the wood cladding will be applied without undesired contact between the moisture and the wood. Suitable openings in the bottom of the sash, which may take the form of small holes, may be provided for ultimate discharge of the moisture. It will be appreciated that in applying the sash cladding to sash member 562, the gap 578 will be preserved.

It will be appreciated that the present invention provides a number of unique structurally sound and effective means for providing a complete window with interior wooden cladding so as to provide the desired wooden appearance. It will be apparent from the foregoing that numerous variations of the frame construction, sash construction and cladding constructions may be employed depending on the structural aesthetic and economical objectives of a particular installation without departing from the present invention. Mullion and muntin cladding means are also provided.

It will be appreciated that the first wood cladding means may be provided with or without screen retention recesses depending upon whether a screen retention feature is desired for aesthetic or functional purposes. Also, the wood cladding lip feature may be included or eliminated in accordance with the desired construction in a particular installation.

Whereas particular embodiments of the invention have been disclosed herein, it will be evident that those skilled in the art that numerous variations of the details may be made without departing from the invention defined in the appended claims.

I claim:

1. A clad window assembly having a sash mounted on a window frame comprising a nonwooden frame having an inner surface, an outer surface, a sash engaging surface and a wall engaging surface, a nonwooden sash having an exterior surface, an interior surface, a pane engaging surface and a frame engaging surface, a pane secured to said sash, said nonwooden frame and said nonwooden sash cooperating to define a window, a plurality of first wood cladding members secured to said nonwooden frame inner surface, a plurality of second wood cladding members secured to said sash, and said first wood cladding members and said second wood cladding members cooperating to provide an interior wood appearance for said nonwooden windows.

2. The window assembly of claim 1 wherein at least two said first wood cladding members having an elongated recess on the side thereof adjacent said sash.

3. The window assembly of claim 2 wherein said window has a fixed sash.

4. The window assembly of claim 2 wherein said window has a movable sash.

5. The window assembly of claim 4 wherein said window is a casement or awning window.

6. The window assembly of claim 2 wherein hardware receiving openings are provided in at least two said first wood cladding members, and hardware means extending through said openings.

7. The window assembly of claim 6 wherein said second wood cladding members are visible from the interior when said window is in a closed position.

8. The window assembly of claim 6 wherein said window has four said first wood cladding members, and each of said four first wood cladding members has a said recess.

9. The window assembly of claim 8 wherein except for said hardware openings said first wood cladding members substantially completely cover said nonwooden frame inner surface.

10. The window assembly of claim 9 wherein at least some of said wood cladding members have decorative means.

11. The window assembly of claim 10 wherein said decorative means are integrally formed within said first wood cladding means.

12. The window assembly of claim 9 wherein said nonwooden sash has mullion means secured thereto, third wood cladding means secured in overlying relationship to said mullion means, and said third wood cladding means having a generally channel shaped configuration.

13. The window assembly of claim 12 wherein said third wood cladding means having at least one elongated recess adjacent one end thereof.

14. The window assembly of claim 13 wherein a pair of said elongated recesses are disposed on opposite sides of said third wood cladding means.

15. The window assembly of claim 9 wherein said second wood cladding members are secured to said sash pane engaging surface.

16. The window assembly of claim 15 wherein said pane is a glass pane, and said second wood cladding members are a glass securing block.

17. The window assembly of claim 16 wherein said second wood cladding members have one surface oriented generally parallel to said pane and another surface oriented generally perpendicular to said pane.

18. The window assembly of claim 15 wherein said nonwooden frame elements and nonwooden sash elements are assembled from extruded materials.

19. The window assembly of claim 6 wherein at least some of said first wood cladding members have an elongated lip projecting generally outwardly from the side of said first wood cladding members adjacent to said frame outer surface.

20. The window assembly of claim 19 wherein said first wood cladding members all have a generally identical shape except for said hardware receiving openings.

21. The window assembly of claim 19 wherein at least one of said first wood cladding members have a first cladding shape different from the shape of other said first wood cladding members, whereby the interior appearance of said window will have some cladded portions of different shape than others.

22. The window assembly of claim 21 wherein said nonwooden frame has a plurality of frame elements, and at least one of said nonwooden frame elements have a first frame shape and at least one of said nonwooden frame elements have a shape different from said first frame shape.

23. The window assembly of claim 22 wherein at least one of said first frame shape elements has a first wood cladding member of a said first cladding shape secured thereto, and each said frame element not having said first frame shape having a said first wood cladding member not of said first cladding shape secured thereto.

24. The window assembly of claim 1 wherein said window is generally rectangular, said window has four said first wood cladding members, and adjacent said first wood cladding members being joined by a mitered joint.

25. The window assembly of claim 1 wherein said window is generally rectangular, said window has four said first wood cladding members, and adjacent said first wood cladding members being joined by a butt joint.

26. The window assembly o claim 1 including said second wood cladding members being generally L-shaped.

27. The window assembly of claim 26 including muntin means secured to said first wood cladding members, whereby said second wood cladding members and said muntin means may be secured to said window as a unit.

28. The window assembly of claim 27 including first fastener means projecting from said nonwooden sash pane engaging surface for securing said second cladding means to said nonwooden sash.

29. The window assembly of claim 28 including said first fastener means being spring biased.

30. The window assembly of claim 29 including said second cladding means having portions with elongated integrally formed grooves for receiving said first fastener means.

31. The window assembly of claim 1 including said nonwooden sash having a pair of horizontal members cooperating with a pair of vertical members to define a pane receiving opening, and said horizontal members having ends spaced from said vertical members to define gaps therebetween, whereby replacement of said pane may be readily effected by removal of said horizontal sash members.

32. The window of claim 31 wherein said first wood cladding means secured to said horizontal members in overlying relationship thereto, and being longer than said horizontal members.

33. The window assembly of claim 1 including said nonwooden sash having a pair of horizontal members cooperating with a pair of vertical members to define a pane receiving opening, and the lower said horizontal member being spaced from said pane to provide a drainage path through which condensation water forming on the inner surface of said pane may flow.

34. The window assembly of claim 33 including drainage channel means underlying said lower horizontal member for receipt of water from said drainage path.

35. The window assembly of claim 34 including outlet means for receiving water from said drainage channel and discharging said water from said drainage

36. A clad window assembly having a sash mounted on a window frame comprising a nonwooden frame having an inner surface, an outer surface, a sash engaging surface, and a wall engaging surface, a nonwooden sash having an exterior surface, an interior surface, a pane engaging surface, and a frame engaging surface, a pane secured to said sash, said nonwooden frame and said nonwooden sash cooperating to define a window, a plurality of first wood cladding members secured to said frame inner surface, a plurality of second wood cladding members secured to said sash, said wood cladding providing a wooden appearance on the inner surface of said window, and at least some of said wood cladding members having an elongated lip projecting generally outwardly from the portion of said first wood cladding member adjacent to said nonwooden frame outer surface.

37. The window assembly of claim 36 wherein said window is a casement or awning window.

38. The window assembly of claim 37 wherein said window has four said first wood cladding members, and all four said wood cladding members have a said lip.

39. The window assembly of claim 38 wherein except for said hardware openings said first wood cladding members substantially completely cover said nonwooden window frame inner surface.

40. The window assembly of claim 39 wherein at least two opposed said first wood cladding members have an elongated recess on the side thereof closer to the sash, whereby a screen frame may be received within said recesses.

41. The window assembly of claim 40 wherein said first wood cladding members all have a generally identical shape except for hardware receiving openings.

42. The window assembly of claim 41 wherein at least two of said first wood cladding members have a shape different from the other said first wood cladding members, whereby the interior appearance of said window will have some cladded portions of different shape than others.

43. The window assembly of claim 42 wherein said nonwooden frame has a plurality of frame elements, and some of said frame elements having a first frame shape different from others.

44. The window assembly of claim 43 wherein each said frame element has said first frame shape and a first wooden cladding member of a first cladding shape, and each said frame element not having said first frame shape has a said first wood cladding member not of said first cladding shape secured thereto.

45. The window assembly of claim 41 wherein said nonwooden sash has mullion means secured thereto, third wood cladding means secured in overlying relationship to said mullion means, and said third wood cladding means mullion having a generally channel shaped configuration.

46. The window assembly of claim 45 wherein said third wood cladding means has at least one elongated recess adjacent one side thereof.

47. The window assembly of claim 46 including said second wood cladding means being a pane securing block.

48. The window assembly o claim 36 wherein said window is generally rectangular, said window has four said first wood cladding members, and adjacent said first wood cladding members are joined by a mitered joint.

49. The window assembly of claim 36 wherein said window is generally rectangular, said window has four said first wood cladding members, and adjacent said first wood cladding members are joined by a butt joint.

* * * * *

UNITED STATES PATENT AND TRADEMARK OFFICE

CERTIFICATE OF CORRECTION

PATENT NO. : 5,081,793

DATED : January 21, 1992

INVENTOR(S) : GERALD D. MAURO

It is certified that error appears in the above-indentified patent and that said Letters Patent is hereby corrected as shown below:

Column 5, line 15, --of-- should be inserted after "variety".

Column 6, line 41, "132" should be --133--.

Column 6, line 66, "frame 10" should be --frame 30--.

Column 10, line 27, "will seen" should read --will be seen--.

Column 11, line 27, "that" should be --to--.

Claim 26, line 1, "o" should be --of--.

Claim 27, line 2, "first" should be --second--.

Claim 32, line 2, "first" should be --second--.

Claim 35, line 4 --channel.-- should be inserted after "drainage".

Claim 42, line 1, "41" should be --40--.

Claim 48, line 1, "o" should be --of--.

Signed and Sealed this

Sixth Day of December, 1994

*Attest:*

*Attesting Officer*

BRUCE LEHMAN

*Commissioner of Patents and Trademarks*